US007898369B2

(12) United States Patent
Kaegebein

(10) Patent No.: US 7,898,369 B2
(45) Date of Patent: Mar. 1, 2011

(54) TEMPERATURE COMPENSATION APPARATUS FOR FREQUENCY STABILIZATION

(75) Inventor: Daniel P. Kaegebein, Depew, NY (US)

(73) Assignee: Comprod Communications Corporation, Boucherville (CA)

( * ) Notice: Subject to any disclaimer, the term of this patent is extended or adjusted under 35 U.S.C. 154(b) by 207 days.

(21) Appl. No.: 12/077,410

(22) Filed: Mar. 18, 2008

(65) Prior Publication Data

US 2008/0278266 A1 Nov. 13, 2008

Related U.S. Application Data

(60) Provisional application No. 60/928,871, filed on May 11, 2007.

(51) Int. Cl.
*H01P 7/06* (2006.01)

(52) U.S. Cl. ..... 333/229; 333/234

(58) Field of Classification Search ..... 333/229, 333/222, 232, 234, 202, 226, 224, 208, 209
See application file for complete search history.

(56) References Cited

U.S. PATENT DOCUMENTS

| | | | | |
|---|---|---|---|---|
| 4,206,428 | A | 6/1980 | Kaegebein | |
| 5,754,084 | A * | 5/1998 | Hietala | 333/229 |
| 6,300,850 | B1 | 10/2001 | Kaegebein | |
| 7,463,121 | B2 * | 12/2008 | D'Ostilio | 333/223 |

OTHER PUBLICATIONS

Definition of teh word "barrel", WWW.MERRIAM-WEBSTER.COM, 2010.*

* cited by examiner

*Primary Examiner* — Benny Lee
*Assistant Examiner* — Gerald Stevens
(74) *Attorney, Agent, or Firm* — Simpson & Simpson, PLLC

(57) ABSTRACT

A temperature compensation apparatus for a cavity filter including a plunger barrel, a compensation barrel having a first coefficient of thermal expansion, wherein the compensation barrel is housed with the plunger barrel, a tuning rod housed primarily within the compensation barrel, the tuning rod having a second coefficient of thermal expansion, and wherein the compensation barrel is physically in contact with the plunger barrel and the tuning rod for allowing a direct transfer of heat between the compensation barrel, the tuning rod, and the plunger barrel.

16 Claims, 5 Drawing Sheets

TEMPERATURE COMPENSATION APPARATUS FOR FREQUENCY STABILIZATION

CROSS REFERENCE TO RELATED APPLICATIONS

This patent application claims the benefit under 35 U.S.C. §119(e) of U.S. Provisional Application No. 60/928,871, filed May 11, 2007.

FIELD OF THE INVENTION

This invention relates to temperature compensation methods and apparatus' for cavity filters, especially cavity filters used in transmitter multicouplers.

BACKGROUND OF THE INVENTION

Cavity filters are known in the art and discussed in detail in U.S. Pat. No. 4,206,428 (Kaegebein '428) and U.S. Pat. No. 6,300,850 (Kaegebein '850), which are incorporated by reference herein. Kaegebein '850 describes a temperature compensating cavity bandpass filter comprising a temperature compensation assembly connecting the movable probe to the tuning support rod. The assembly is a bi-metal structure that varies the position of the movable probe as a result of the temperature. Although effective for temperature compensation, the assembly described in Kaegebein '850 is limited in transmission power throughput because of a lack of adequate heat dissipation within the cavity. Specifically, the aluminum tubes of the assembly have no direct connection to the movable probe or the running support rod and rely only upon their close proximity for heat transfer. Furthermore, the relative complexity and poor heat dissipation of the system described in Kaegebein '850 reduces the overall reliability of the system.

Thus, what is needed is a temperature compensation apparatus for frequency stabilization that overcomes limited transmission power throughput and reduced reliability due to poor heat dissipation.

BRIEF SUMMARY OF THE INVENTION

The present invention broadly comprises a temperature compensation apparatus for a cavity filter including a plunger barrel, a compensation barrel having a first coefficient of thermal expansion, wherein the compensation barrel is housed within the plunger barrel, a tuning rod housed primarily within the compensation barrel, the tuning rod having a second coefficient of thermal expansion, and wherein the compensation barrel is physically in contact with the plunger barrel and the tuning rod for enabling a direct transfer of heat between the compensation barrel, the tuning rod, and the plunger barrel.

In one embodiment the plunger barrel has a closed end, which includes first and second threaded holes, wherein the first threaded hole is centrally located in the closed end of the plunger barrel. In a further embodiment, a support rod of a cavity filter passes through the plunger barrel, and is threadedly engaged with the first threaded hole in the closed end of the plunger barrel. In another embodiment, the compensation barrel includes a set screw operatively arranged to lock the tuning rod in place with respect to the compensation barrel.

In yet another embodiment, the temperature compensation apparatus includes a contact finger component operatively threaded to engage with the second threaded hole in the closed end of the plunger barrel, and a portion of the threaded contact finger component extends inside the plunger barrel. In a further embodiment, the compensation barrel is operatively threaded to engage with the portion of the contact finger component which extends into the plunger barrel.

In yet another embodiment, the temperature compensation apparatus is included in a bandpass, notch, x-pass, or pass-reject cavity filter. The difference between the coefficients of thermal expansion for the tuning rod and compensation barrel acts to substantially nullify any effects from temperature induced dimensional changes of the cavity filter. The direct connection of the compensation barrel, contact finger component, tuning rod, and plunger barrel enables better heat transfer and heat dissipation in the cavity filter, and therefore a higher power throughput.

It is a general object of the present invention to provide a temperature compensation apparatus to substantially nullify any effects from temperature induced dimensional changes of a cavity filter.

It is another object of the present invention to provide a temperature compensation apparatus which allows for a higher power throughput in a cavity filter with respect to previous temperature compensation methods.

It is yet a further object of the present invention to provide a temperature compensation apparatus with the above objects, which is reliable and easy to manufacture.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention.

While the present invention is described with respect to what is presently considered to be the preferred aspects, it is to be understood that the invention as claimed is not limited to the disclosed aspects.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
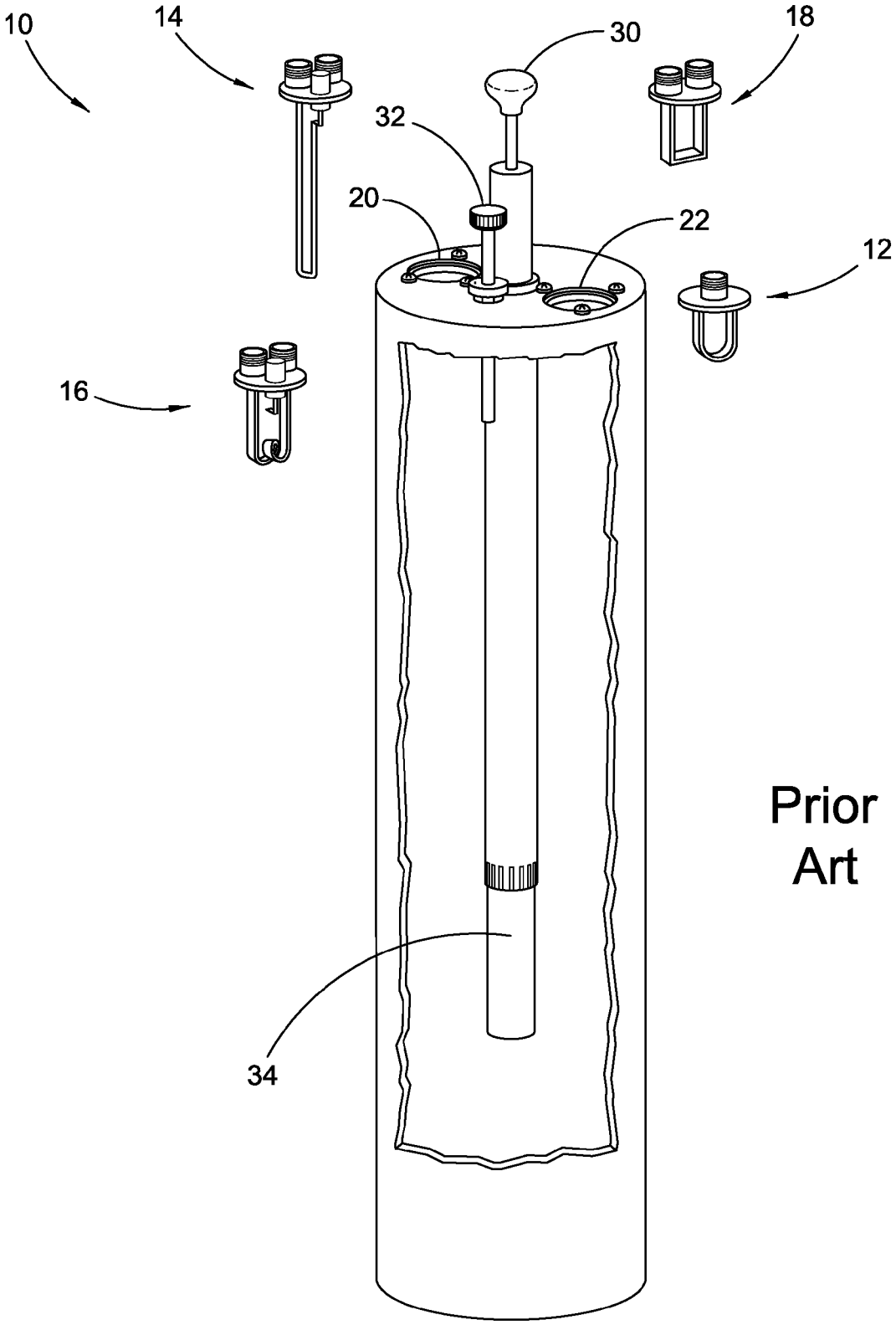
FIG. 1 is a perspective view of a known cavity filter having a portion cut-out to reveal the inside of the cavity filter, illustrated along with bandpass, notch, pass-reject and x-pass loops.

FIG. 1 is a perspective view of cavity filter 10, with a cut out showing the interior of cavity filter 10. Such cavity filters are known in the art. Cavity filter 10 can be arranged as a bandpass, notch, pass-reject or x-pass filter by means of inserting any of bandpass loop 12, notch loop 14, pass-reject loop 16 or x-pass loop 18, respectively, into slots 20 and 22. Cavity filters of these designs are usually arranged in series in transmitter multicoupler channels.

A bandpass cavity filter preferably passes one narrow band of frequencies and attenuates all others with increasing attenuation above and below the pass frequency. The adjustable selectivity characteristics (rotatable loops) allow a tradeoff between insertion loss (0.5-3.0 dB) and selectivity. This filter is ideal when the interfering frequencies are not known to any degree of accuracy or when very broadband filtering is needed.

A notch cavity filter preferably passes a relatively wide band of frequencies, while rejecting a very narrow band of frequencies. Notch depth is variable from 15-25 dB. Both pass and notch frequencies must be known. The wide passband can be an advantage when filtering multiple channel transmitters and receivers. This filter is ideal for very close separations (70-200 KHz) in VHF and (200-400 KHz) in UHF.

A pass-reject cavity filter preferably rejects one relatively narrow band of frequencies while passing a second relatively narrow band of frequencies. This filter has the greatest notch depth when compared to other types. Notch depth is adjustable, but is referred to a passband insertion loss (0.3 dB or 0.6 dB typical). Usually, this is the best filter type for moderately close to wide separations (200 KHz and greater in VHF and 400 KHz and greater in UHF).

An x-pass cavity filter is a special type of filter for expandable multicoupler/combiner applications. Characteristics are identical to a bandpass filter, but have a third port for coupling to other channels. This filter is ideal for close frequency spacing with extremely low losses, as in a cavity ferrite multicoupler/combiner.

Preferably, cavity filters are 6.625" or 10" diameter filters and a tuning means comprising two hand movable tuning rods. Specifically, coarse tuning support rod 30 and fine tuning rod 32 allow for faster tuning capability. Support rod 30 is arranged to alter the position of internal moveable probe 34, which enables coarse tuning. The temperature compensation assembly disclosed in the '850 patent to Kaegebein would be inserted within internal moveable probe 34.

Figure 2:
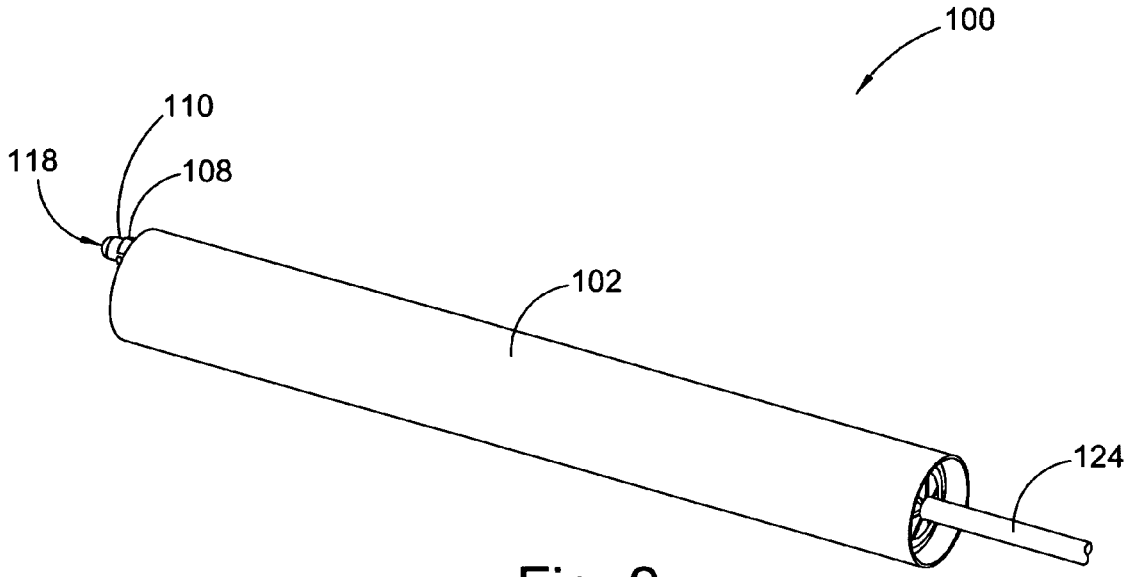
FIG. 2 is a perspective view of the present invention temperature compensation apparatus.
Figure 3:
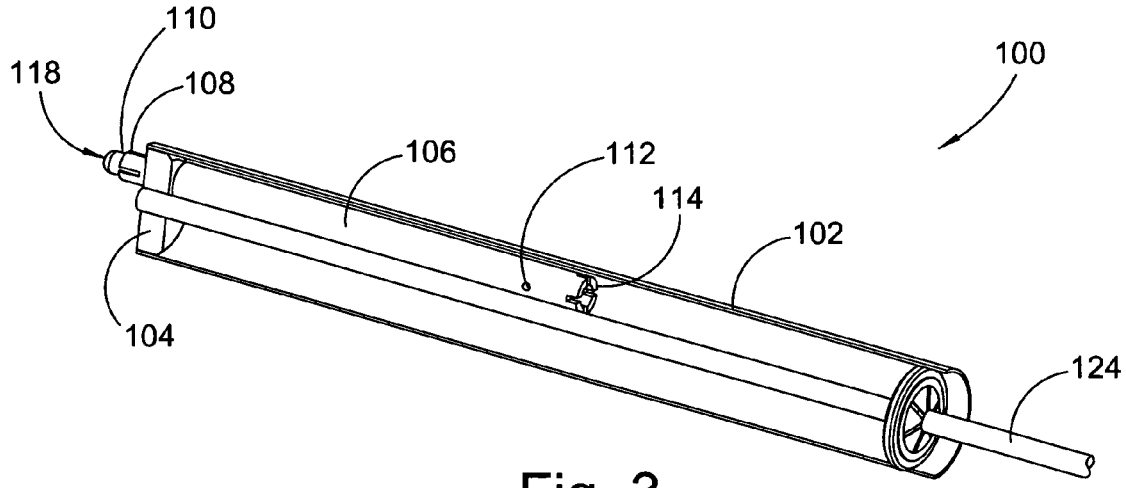
FIG. 3 is a perspective view of the temperature compensation apparatus of FIG. 2, illustrated as substantially cut in half longitudinally, to show the inside of the temperature compensation apparatus.
Figure 4:
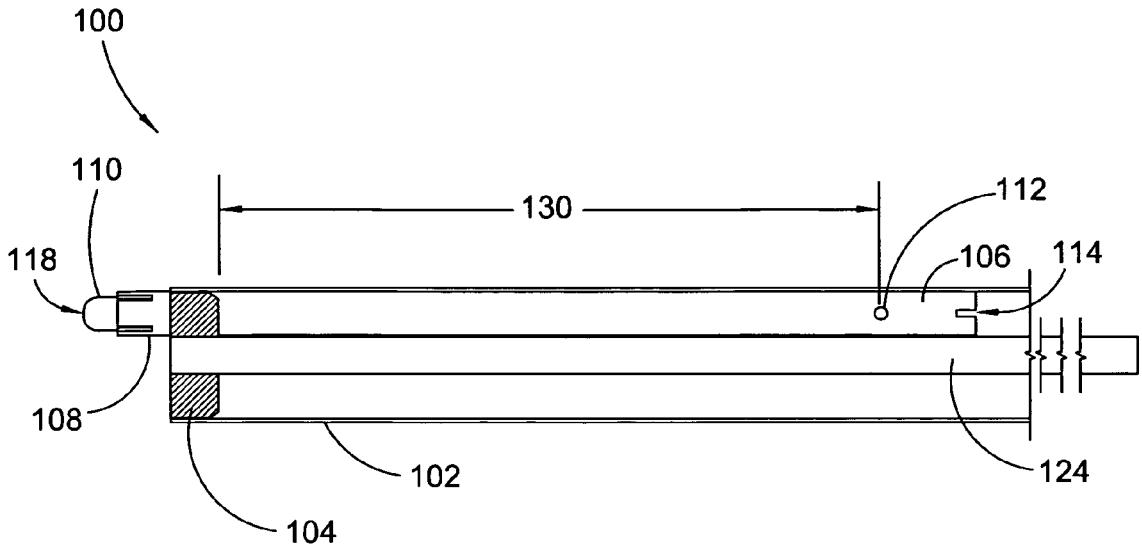
FIG. 4 is a side view of the half of the temperature compensation apparatus shown in FIG. 3.
Figure 5:
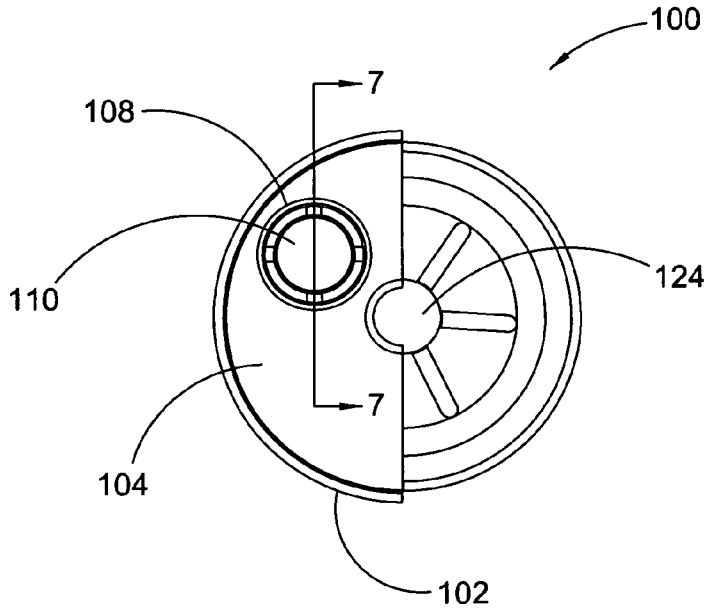
FIG. 5 is a front view of the temperature compensation apparatus as illustrated in FIG. 4.

In accordance with the present invention, internal moveable probe 34 is replaced by temperature compensation apparatus 100, as is illustrated in FIGS. 2-6. When the current invention temperature compensation apparatus is installed in a cavity filter, the remaining components shown in FIG. 1 remain essentially the same. FIGS. 3 and 4 show apparatus 100 with half of plunger barrel 102 removed, to show the inside of the plunger barrel. Apparatus 100 broadly includes moveable plunger barrel 102 having bushing or collar 104 secured at an end of plunger barrel 102. In a preferred embodiment, plunger barrel 102 is a hollow cylinder, and bushing 104 is secured at one end of the plunger by hard soldering, to act as an end cap for plunger barrel 102. Plunger barrel 102 is preferably made from brass that is copper and silver plated.

Support rod 124 is shown extending out of the end of plunger barrel 102 on the right side of the drawing in FIGS. 2-4. Support rod 124 is analogous to support rod 30 in FIG. 1, and performs the same coarse tuning function. Therefore, in the present invention, support rod 124 is used to manually adjust the position of temperature compensation apparatus 100 when apparatus 100 is installed in a cavity filter. The opposite end of support rod 124 is secured to bushing 104, preferably by a threaded connection. Bushing 104 is preferably made from brass.

Positioned within plunger barrel 102 is compensation barrel 106. In a preferred embodiment, compensation barrel 106 includes set screw hole 112, which is arranged to accept a set screw for securing tuning rod 110 in place with respect to compensation barrel 106. Compensation barrel 106 is secured to contact finger component 108, preferably by a threaded connection means. Compensation barrel 106 is preferably made from aluminum and has four slots 114 spaced ninety degrees apart from each other at one end, and a threaded second end 116. Since compensation barrel 106 is cylindrical, slots 114 enable a tool to grip onto and rotate the compensation barrel, so that threaded end 116 can be easily threaded onto contact finger component 108. In a preferred embodiment, contact finger component 108 is fabricated from silver plated brass. Tuning rod 110 passes through contact finger component 108, and is generally housed within compensation barrel 106, with just end 118 protruding from contact finger component 108.

Tuning rod 110 is preferably cylindrical in shape having a full radius rounded end 118. Also, in a preferred embodiment, tuning rod 110 is made from a nickel steel alloy having 36% nickel. Additionally, tuning rod 110 is preferably plated with copper and silver. The difference in the coefficients of thermal expansion between tuning rod 110 and compensation barrel 106 is what enables temperature compensation apparatus 100 compensate for and nullify any effects on an operating frequency of the cavity filter from temperature induced dimensional changes of the cavity filter. Specifically, the temperature compensation apparatus enables a cavity filter to experience an array of different temperatures without the need to be re-tuned, and while operating at a substantially stable frequency. Alternatively stated, the temperature compensation apparatus stabilizes the operating frequency of a cavity filter so that the frequency does not drift as the cavity filter, particularly the tuning means of the cavity filter, experiences temperature induced dimensional changes.

Figure 6:
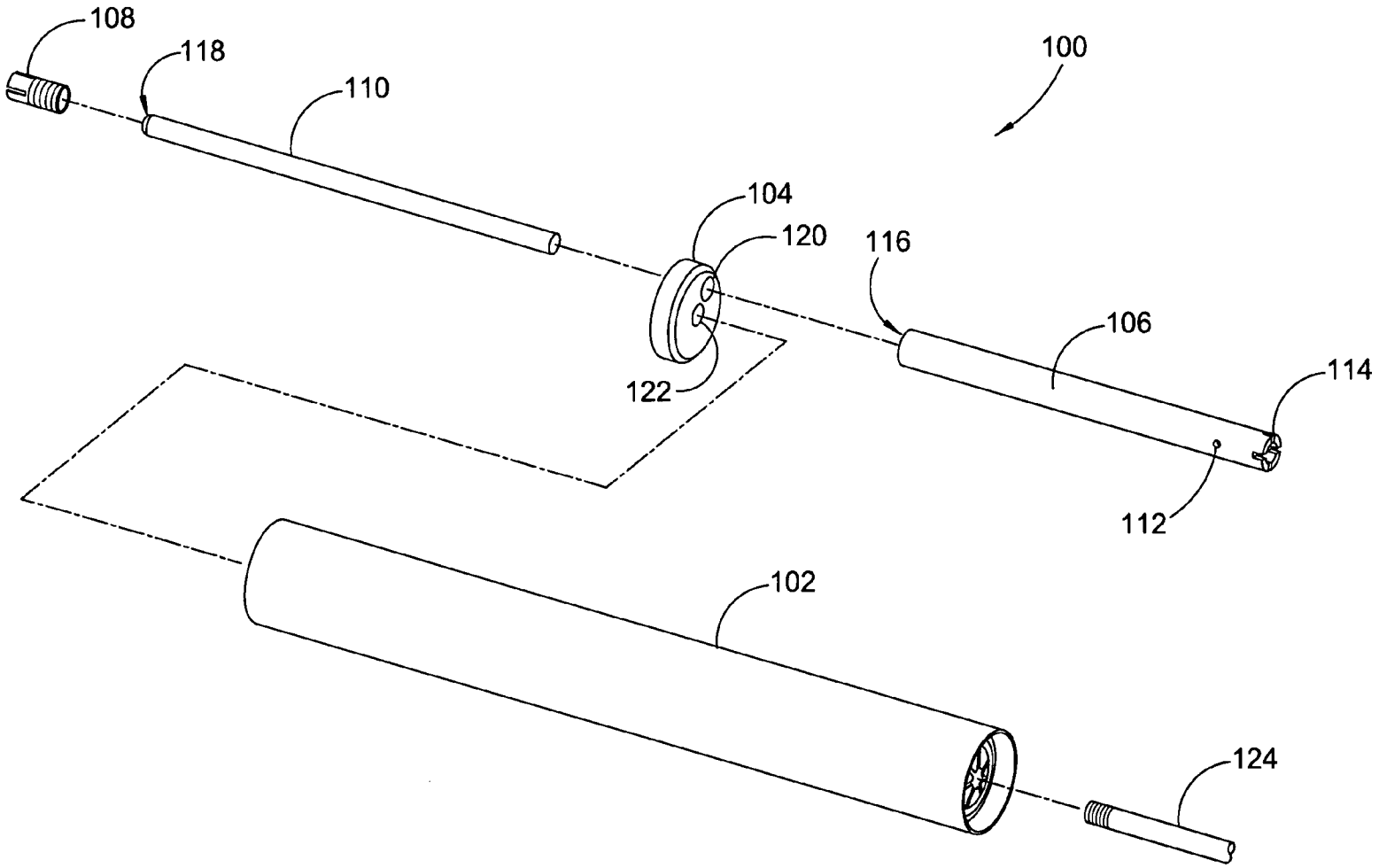
FIG. 6 is an exploded view of the temperature compensation apparatus shown in FIG. 2.

FIG. 6 is an exploded view of apparatus 100. It can be seen that support rod 124 passes through plunger barrel 102, and is threadedly secured to bushing 104 by support rod hole 122. In a preferred embodiment, bushing 104 is hard silver soldered in one end of plunger barrel 102. In addition to support rod hole 122, bushing 104 further includes contact finger component hole 120, which is arranged to threadingly engage with contact finger component 108. It can also be seen that compensation barrel 106, contact finger component 108, tuning rod 110, and contact finger component hole 120 are all coaxial.

Figure 7:
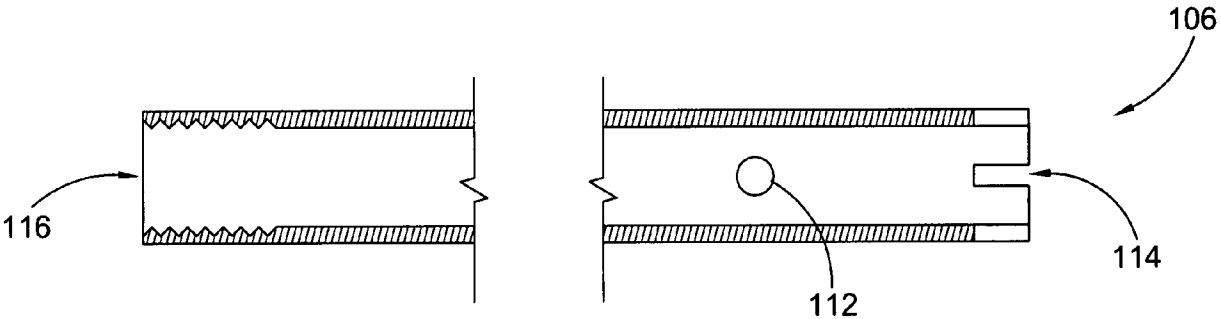
FIG. 7 is a cross-sectional view of just the compensation barrel for the temperature compensation apparatus taken generally along line 7-7 in FIG. 5, with the other components removed for clarity; and, FIG. 8 is a perspective view of a compensation barrel, tuning rod, contact finger component and bushing for the temperature compensation apparatus of FIG. 2 partially assembled.

FIG. 7 shows a cross-sectional view of compensation barrel 106. It can be seen that compensation barrel 106 is operatively hollow throughout to enable tuning rod 110 to be inserted into the compensation barrel. It can also be seen that the compensation barrel includes threaded end 116, which is opposite from slots 114. Threaded end 116 is internally threaded so that the compensation barrel can be secured to contact finger component 108.

Figure 8:
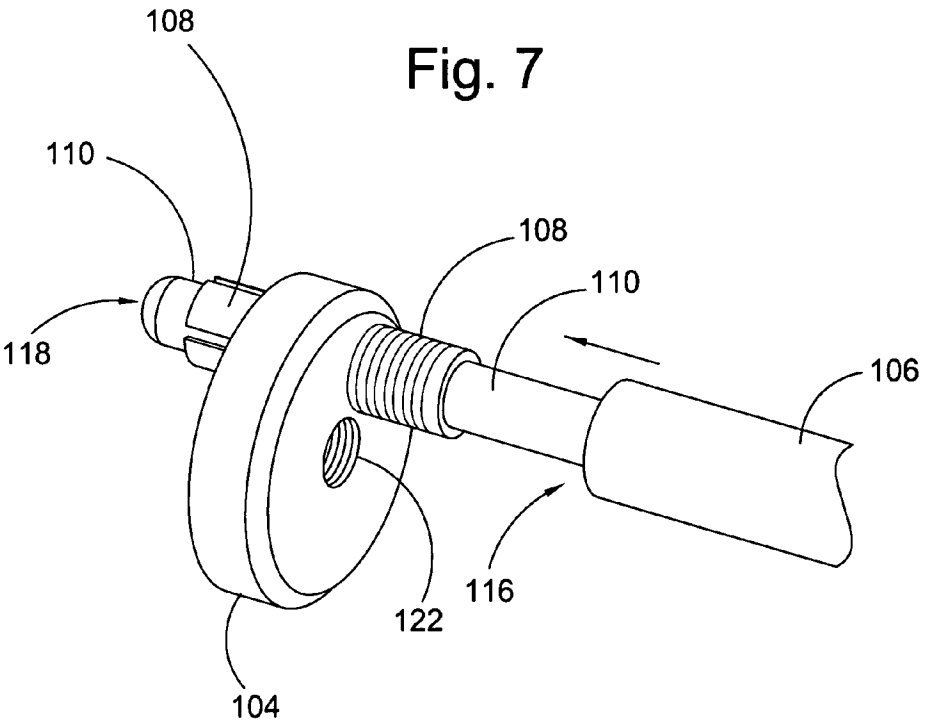

Compensation barrel 106, tuning rod 110, bushing 104, and contact finger component 108 are shown in FIG. 8. Contact finger component 108 is shown threaded into hole 120 in bushing 104. A portion of contact finger component 108 is shown protruding from both sides of bushing 104. Tuning rod 110 is inserted through the contact finger component and bushing. Compensation barrel 106 is then threaded onto the portion of the contact finger component that is protruding from the bushing, thereby enclosing the tuning rod. In this way, all of the shown components are directly connected together. By directly connected together, we mean they are connected so that conduction can readily occur between these components. It should be appreciated that some components are not physically touching, such as the tuning rod and bushing, but are still considered directly connected for the present purposes, since they are separated by other thermally conductive components (specifically, the contact finger component), and therefore can readily transfer heat between each other.

From the previous Figures, it should be apparent that tuning rod 110, contact finger component 108, compensation barrel 106 and bushing 104 are in direct contact with rod 124 and moveable plunger 102, allowing for more efficient heat transfer over the prior art. As is known in thermodynamics, conduction generally allows for significantly better heat transfer than convection, as was used in the prior art '850 patent to Kaegebein. More efficient heat transfer allows for a cavity filter to pass-through a higher level of transmission power without failure due to frequency drift. That is, the filter will continue to perform adequately even at higher transmission power levels. Additionally, the advantageously improved heat transfer increases the reliability of operation of the current invention by reducing the risk of material failure.

Referring back to FIG. 4, distance 130, is the distance between set screw hole 112 and then end of the compensation barrel. Distance 130 is determined experimentally as the distance which enables the cavity filter to exhibit a minimum allowable cavity frequency shift under typical transmitter power levels. For example, transmitter power could be applied at power levels of 100-150 watts and 2.5 dB insertion loss and at various frequencies over a desired band of operation to determine an optimal lock point for the broadest frequency range of operation for the compensation barrel.

It should be appreciated that the temperature compensation apparatus and method described herein is not limited to any particular measurements or dimensions. Additionally, the temperature compensation apparatus described herein should not be limited to any particular cavity filter or materials.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A temperature compensation apparatus for a cavity filter having a tuning assembly comprising:

a plunger barrel housed within said cavity filter and secured to a support rod of said tuning assembly of said cavity filter of said cavity filter, said support rod operatively arranged to set a position of said plunger barrel with respect to said cavity filter;

a compensation barrel having a first coefficient of thermal expansion, wherein said compensation barrel is housed within said plunger barrel;

a tuning rod housed primarily within said compensation barrel, said tuning rod having a second coefficient of thermal expansion; and, wherein said compensation barrel is in direct contact with said plunger barrel and said tuning rod for enabling a direct transfer of heat between said compensation barrel, said tuning rod, and said plunger barrel wherein a difference between said first and second coefficients of thermal expansion enables said temperature compensation apparatus to substantially nullify any effects from temperature induced dimensional changes of said tuning assembly of said cavity filter.

2. The temperature compensation apparatus recited in claim 1 wherein said compensation barrel is fabricated from aluminum.

3. The temperature compensation apparatus recited in claim 1 wherein said tuning rod is fabricated from a nickel-steel alloy.

4. The temperature compensation apparatus recited in claim 3 wherein said nickel-steel alloy contains 36% nickel.

5. The temperature compensation apparatus recited in claim 1 further comprising a securing means operatively arranged to lock said tuning rod in place with respect to said compensation barrel.

6. The temperature compensation apparatus recited in claim 5 wherein said securing means is a set screw.

7. The temperature compensation apparatus recited in claim 1 wherein said plunger barrel includes a closed end, and wherein said closed end includes first and second threaded holes.

8. The temperature compensation apparatus recited in claim 7 wherein said support rod from said cavity filter is threadedly engaged with said first threaded hole in said closed end of said plunger barrel.

9. The temperature compensation apparatus recited in claim 7 further comprising a contact finger component threadedly engaged with said second threaded hole in said closed end of said plunger barrel.

10. The temperature compensation apparatus recited in claim 9 wherein a portion of said tuning rod protrudes out of said compensation barrel and said plunger barrel via said contact finger component.

11. The temperature compensation apparatus recited in claim 9 wherein said compensation barrel is threadedly engaged with said contact finger component.

12. A cavity filter assembly the temperature compensation apparatus from claim 1.

13. The cavity filter assembly recited in claim 12 wherein a difference between said first and second coefficients of thermal expansion enables said temperature compensation apparatus to substantially nullify any effects from temperature induced dimensional changes of said cavity filter assembly.

14. The cavity filter assembly recited in claim 12 wherein said cavity filter is used in radio-frequency transmitting and receiving systems.

15. The cavity filter assembly recited in claim 12, wherein said cavity filter is selected from a group consisting of band-pass, notch, x-pass, and pass-reject filters.

16. A temperature compensation apparatus for a cavity filter comprising:

a plunger barrel;

a bushing secured in said plunger barrel to create a closed end for said plunger barrel, wherein said closed end includes first and second threaded holes;

a support rod passing through said plunger barrel, threadedly engaged with said first threaded hole in said closed end of said plunger barrel;

a contact finger component operatively threaded to engage with said second threaded hole in said closed end of said plunger barrel, wherein a portion of said threaded contact finger component extends inside said plunger barrel;

a compensation barrel housed within said plunger barrel, wherein a first end of said compensation barrel is operatively threaded to engage with said portion of said contact finger component which extends into said plunger barrel, said compensation barrel having a first coefficient of thermal expansion;

a tuning rod substantially housed within said compensation barrel, wherein a first end of said tuning rod is rounded to a full radius and protrudes slightly out of said contact finger component, said tuning rod having a second coefficient of thermal expansion;

a set screw operatively arranged in said compensation barrel to lock said tuning rod in place with respect to said compensation barrel;

wherein a difference between said first and second coefficients of thermal expansion enables said temperature compensation apparatus to substantially nullify any effects on an operating frequency of said cavity filter from temperature induced dimensional changes of said cavity filter; and, wherein said compensation barrel is in direct contact with said plunger barrel, said tuning rod, and said contact finger component for enabling direct transfer of heat between said compensation barrel, said tuning rod, said contact finger component and said plunger barrel.

* * * * *